US007160352B2

(12) United States Patent
Le Biez et al.

(10) Patent No.: US 7,160,352 B2
(45) Date of Patent: Jan. 9, 2007

(54) POWDER MATERIAL FOR AN ABRADABLE SEAL

(75) Inventors: Philippe Le Biez, Draveil (FR); Philippe Perruchaut, Pau (FR); Karim Larabi, Epinay sur Seine (FR); Pierre Bertrand, Montbelliard (FR); Christian Coddet, Giromagny (FR)

(73) Assignee: SNECMA Moteurs, Paris (FR)

( * ) Notice: Subject to any disclaimer, the term of this patent is extended or adjusted under 35 U.S.C. 154(b) by 142 days.

(21) Appl. No.: 10/727,603

(22) Filed: Dec. 5, 2003

(65) Prior Publication Data

US 2004/0112174 A1 Jun. 17, 2004

(30) Foreign Application Priority Data

Dec. 13, 2002 (FR) ..... 02 15799

(51) Int. Cl.
*B22F 1/00* (2006.01)

(52) U.S. Cl. ..... 75/252; 428/324

(58) Field of Classification Search ..... 75/252; 428/328, 324

See application file for complete search history.

(56) References Cited

U.S. PATENT DOCUMENTS

| | | | | |
|---|---|---|---|---|
| 3,077,659 A | | 2/1963 | Holzwarth et al. | |
| 3,147,087 A | | 9/1964 | Eisenlohr | |
| 3,167,403 A | * | 1/1965 | Smith et al. | 428/653 |
| 4,595,429 A | * | 6/1986 | Le Caer et al. | 148/403 |
| 4,606,967 A | * | 8/1986 | Mosser | 428/220 |

FOREIGN PATENT DOCUMENTS

| | | | |
|---|---|---|---|
| DE | 196 01 793 A1 | | 7/1997 |
| EP | 0 459 114 A1 | | 12/1991 |
| EP | 0 487 273 A1 | | 5/1992 |
| EP | 0486 319 A1 | | 5/1992 |
| EP | 0489427 | * | 6/1992 |
| EP | 1 010 861 A2 | | 6/2000 |
| EP | 1 036 855 A1 | | 9/2000 |
| GB | 604457 | | 7/1948 |
| GB | 1077256 | | 7/1967 |
| WO | WO 01/44533 A1 | | 6/2001 |

* cited by examiner

*Primary Examiner*—Ngoclan T. Mai
(74) *Attorney, Agent, or Firm*—Oblon, Spivak, McClelland, Maier & Neustadt, P.C.

(57) ABSTRACT

A powder material for forming an abradable coating, the material comprising a metal powder based for the most part on aluminum and containing manganese or calcium. The material is applicable to seals of a turbomachine.

20 Claims, No Drawings

POWDER MATERIAL FOR AN ABRADABLE SEAL

FIELD OF THE INVENTION

The present invention relates to the general field of powder materials for making abradable seals. A particular application of the invention lies in the field of turbomachines.

DESCRIPTION OF THE BACKGROUND

Materials having the property of abradability are commonly used in numerous applications, and in particular for forming seals. Abradable seals are used in particular in association with the rotary parts of a turbomachine, such as its compressors, in order to reduce leakage of air or gas that might otherwise affect the efficiency of the turbomachine.

Such a turbomachine compressor consists in a plurality of blades secured to a shaft which is mounted in a stationary ring. In operation, the shaft rotates together with the blades inside the compressor ring.

In order to guarantee suitable efficiency for the turbomachine, it is important for leaks of air and gas in the compression sections of the turbomachine to be reduced to as little as possible. This reduction of leaks is obtained by minimizing the clearance that exists firstly between the tips of the blades and the inside surface of the compressor ring, and secondly between the inter-disk shrouds and the outside surface of the stator. Nevertheless, thermal expansion and centrifugal expansion of the compressor blades makes it difficult to obtain small clearance between the tips of the blades and the inside surface of the compressor ring.

Under such conditions, the inside surface of the compressor ring is generally covered in a coating of abradable material, and the shaft of the compressor is mounted in the compressor ring in such a manner that the tips of the blades are as close as possible to the abradable coating. The role of such an abradable coating is thus to form a seal between the stationary portions and the moving portions of the compressors of a turbomachine.

When contact occurs between the stationary portions and the moving portions of the compressor, the seal of abradable material makes it possible to obtain small clearance without damaging the parts of the rotor that come into contact. Interference between the stationary parts and the moving parts of compressors is due essentially to differential expansion of the stationary and moving parts during transient conditions in the operation of such compressors. Phenomena of blade creep, unbalance, and vibration can also lead to such interference.

In such interference situations, it is important for the seals to satisfy the following criteria:

- the tips of the blades must not be subjected to excessive wear. Although a small amount of wear can be tolerated, it is preferable in the event of contact for it to be the seal that is damaged;
- contact between the blade tips and the gaskets must not lead to the blades being heated, particularly when the blades are made of titanium alloy, where such heating can start a fire;
- the seals must withstand the erosion caused by the flow of gas traveling in the flow section of the compressor;
- the seals must also conserve their abradability in an environment that is oxidizing and corrosive. The rise in temperature in compressors leads to oxidation and the combustion gases of the turbomachine and the outside air lead to corrosion of the environment;
- in the event of the seals being worn, the residue must not obstruct the orifices for cooling the compressors;
- finally, the abradable material forming the seals must withstand high temperatures without presenting modifications such as hardening, becoming brittle, and crumbling, which could degrade its capacity to be abraded. The abradable material must be capable of withstanding the various operating cycles of the turbomachine without being degraded.

Numerous powder materials for forming abradable seals have been proposed. These various materials can be classified mainly into two categories: materials having a silicon-based metal powder (e.g. a material comprising an AlSi alloy and an organic powder); and materials having a metal powder based on chromium and nickel (e.g. a material containing an NiCrAl alloy and a ceramic, organic, or clay powder). Nevertheless, those abradable materials suffer from drawbacks depending on the category to which they belong.

Materials based on silicon possess abradability and erosion characteristics that are satisfactory, but their suitability for use at high temperatures is limited. For example, the powder material described in U.S. Pat. No. 5,434,210 is known. That material is limited to a utilization temperature of about 400° C. Above that temperature, the metal matrix of the material shrinks and densifies, which can lead to wear on the facing blade tips.

As for materials based on chromium and nickel, they are relatively stable and good at withstanding high temperatures, however their abradability and erosion characteristics are not good enough, particularly when they are deposited facing compressor blades made of non-coated titanium alloy. For example although an NiCrAl alloy has good high-temperature behavior, it is relatively-hard, and thus leads to excessive wear of the blades.

In order to mitigate such a drawback, it is possible to have recourse to a protective coating on the tips of the blades. Nevertheless, the-use of such a coating is particularly expensive.

SUMMARY OF THE INVENTION

An object of the present invention is thus a powder material for forming an abradable coating for seals, which material satisfies the criteria listed above.

Another object of the invention is to provide an abradable coating that presents satisfactory behavior for applications at temperatures that may be as high as 550° C.

Yet another object of the invention is to provide an abradable seal that can be used facing blades or wipers made of titanium alloy without it being necessary to have recourse to a protective coating on the tips thereof.

To this end, the invention provides a powder material for forming an abradable coating, the material comprising a metal powder based for the most part on aluminum and containing manganese or calcium.

The thermal properties of this novel powder material are better than those of the materials presently in use for making abradable gaskets. The Applicant has observed that the eutectic pause temperature of an AlMn or AlCa alloy is sufficiently high compared with that of an AlSi alloy, for example, for it to be possible to reach temperatures of about 550° C. without transformation or degradation of the material.

Advantageously, an organic powder is added in order to increase the porosity of the resulting coating, so as to encourage abradability on contact being made between the moving and stationary parts, and so as to enable the temperature of the coating to be raised.

Furthermore, adding a lubricating powder of solid ceramic advantageously makes it possible to obtain inter-flake decohesion that is sufficient to avoid heating the blade when contact occurs between the moving and stationary parts. The resulting powder material thus satisfies the above-mentioned criteria. It is entirely suitable for forming an abradable coating, particularly for seals in turbomachine compressors.

Advantageously, the ceramic powder comprises one of the following components: boron nitride, molybdenum disulfide, graphite, talc, bentonite, and mica, and the organic powder comprises any one of the following components: polyester, polymethyl methacrylate, and polyimide.

The metal powder preferably represents 65% to 95%, the ceramic powder preferably represents 3% to 20%, and the organic powder preferably represents 5% to 20% of the total weight of the material.

The metal powder may also include one or more of the following additional elements: chromium, molybdenum, nickel, silicon, and iron. The manganese or the calcium forming the metal powder advantageously represents 5% to 20% and the additional elements represent no more than 10% by weight of the metal powder.

In a preferred embodiment of the invention, the metal powder is an AlMn5 alloy, the ceramic powder is hexagonal boron nitride, and the organic powder is polyester.

DETAILED DESCRIPTION OF THE INVENTION

The powder material of the invention is for making an abradable material such as a coating for seals in turbine compressors or rings, for example.

The powder material essentially comprises a metal powder of an alloy based for the most part on aluminum.

The second main metal element in the alloy is manganese or calcium at a content of 5% to 20% by weight of the metal powder.

The metal powder (of the AlMn or AlCa type) may also include one or more of the following additional metal elements: chromium, molybdenum, nickel, silicon, and iron. The individual quantities of each of these additional elements should not exceed 5% of the weight of the metal powder, and the total quantity of these additional elements should not exceed 10% of the same weight.

The powder material preferably further includes an organic powder comprising one or more of the following components: polyester, polymethyl methacrylate, and polyimide. It may also be composed of any other material of the polymer type, for example polyethylene, polyvinyl acetate, or polyaramid.

In addition, a ceramic powder may advantageously be added. The ceramic powder comprises one or more of the components selected from the following group of solid ceramic lubricants: boron nitride, molybdenum disulfide, graphite, talc, bentonite, and mica. It may also be composed of other stratified materials based on silicates such as, for example, kaolin and other clays.

The metal, lubricating, and organic powders prepared in this way are preferably mixed together in the following proportions: the metal powder represents 65% to 90% of the total weight of the material, the ceramic powder lies in the range 5% to 20%, and the organic powder lies in the range 5% to 15%.

The powders can be mixed mechanically. This method consists in mechanically mixing the various components and because of the compression and shear forces generated by the mixer, in obtaining agglomerates each constituted by the initial components.

However, mixing may also be obtained by some other method such as agglomeration-drying or melting-grinding.

In a preferred embodiment, the powder material comprises a metal powder of aluminum and manganese alloy (AlMn5), a ceramic powder of hexagonal boron nitride (hBN), and an organic powder of polyester (PE). Advantageously, the AlMn5 alloy represents about 75% of the total weight of the material, the hexagonal boron nitride represents about 15% of the total weight, and the polyester represents about 10% of the total weight of the material.

The powder material obtained in this way is for thermal sputtering-using conventional techniques (e.g. plasma techniques or flame techniques) in order to form an abradable coating.

It may be advantageous to subject the abradable coating to sublimation heat treatment in order to create cavities in the material and thus increase its porosity. Such sublimation has the effect of eliminating the organic powder so as to enable tests to be performed under conditions of use that are close to reality, where the organic component is necessarily eliminated.

Test

A powder mixture for thermal sputtering was prepared by mechanically mixing 75% by weight of an AlMn5 powder with 10% by weight of PE and 15% by weight of hBN. A nickel-based substrate-was coated with an underlayer of NiAl5. The powder obtained in this way was then plasma-sputtered onto the substrate. The sputtering parameters used during this test are summarized in the following table:

| Plasma gas | Argon | Hydrogen |
|---|---|---|
| Flow rates (liters per minute) | 50–70 | 2.5–5 |
| Pressure (kPa) | 100–150 | 120–170 |
| Current (A) | 500 | |
| Voltage (V) | 31 | |
| Sputtering distance | 130 mm | |

The parameters of the injector used were as follows:

| | |
|---|---|
| Nozzle diameter | 6 mm |
| Injector size | 2 mm |
| Injector angle | 90° |
| Displacement speed | 1600 mm/s |
| Sweep interval | 5.5 mm |

The coating obtained after such sputtering formed an abradable coating presenting a thickness of about 3 mm. The hardness of the coating was measured using the Rockwell R15Y indentation scale which gives the hardness of a coating. In the present case, the tested coating presented an R15Y indentation value of about 70.

The substrate sample as coated in this way was then subjected to a step of sublimation at 500° C. for four hours.

At the end of the sublimation, the coating presented an R15Y indentation value of about 60.

The coating was evaluated on an abradability test bench facing blades of non-coated titanium alloy. The suitability of the seal for wear was measured under the following test conditions:

| Test temperature | Ambient temperature |
|---|---|
| Number of blades | 3 |
| Blade thickness | 0.8 mm |
| Blade tip speed | 200 m/s |
| Incursion speed | 0.15 mm/s |
| Penetration | 0.5 mm |

The various measurements performed relate to the following points: forces along three axes (radial (penetration) Fr, circumferential (cutting) Fc, and axial (carriage displacement) Fa) and blade wear was measured. Table I below shows the results, in comparison with results obtained on a prior art coating constituted by an AlSi mixture, an organic powder, and hexagonal boron nitride (Table II).

TABLE I

| State of | Force (Newtons) | | | Blade wear (mm) | | |
|---|---|---|---|---|---|---|
| coating | Fr | Fc | Fa | No. 1 | No. 2 | No. 3 |
| Not aged | 3.2 | 3.2 | 2.9 | +0.01 | +0.03 | +0.01 |
| 250 hours at 500° C. | 2.85 | 4 | 2.4 | +0.01 | +0.03 | +0.05 |
| 500 hours at 500° C. | 2.6 | 5.6 | 2.5 | 0 | +0.02 | +0.01 |
| 500 hours at 550° C. | 3.5 | 3.7 | 4.9 | +0.01 | +0.01 | 0 |

TABLE II

| State of | Force (Newtons) | | | Blade wear (mm) | | |
|---|---|---|---|---|---|---|
| coating | Fr | Fc | Fa | No. 1 | No. 2 | No. 3 |
| Not aged | 11 | 2.25 | 0.5 | 0 | 0 | −0.01 |
| 250 hours at 500° C. | 8.7 | 2.8 | 0.5 | +0.02 | +0.03 | +0.02 |
| 500 hours at 500° C. | 4 | 2.8 | 0.5 | +0.02 | 0 | 0 |

In view of these results, the abradable seal obtained in this way presents good properties of resisting erosion compared with the conventional gasket of Table II. It is capable of being worn by contact with blades made of metal alloys, in particular non-coated titanium alloys, without giving rise to wear of the blades. The metallurgical stability of the seal also enables it to withstand high temperatures of about 550° C., unlike the conventional gasket of Table II which cannot withstand temperatures that high.

What is claimed is:

1. A powder material for forming an abradable coating, the material comprising:

a metal powder based for the most part on aluminum and containing manganese or calcium, the manganese or calcium of said metal powder representing 5% to 20% by weight of said metal powder, and said metal powder comprising one or more additional metal elements, individual quantities of each additional metal element being less than 5% of the weight of the metal power; and an organic powder, said organic powder representing 5% to 15% of the total weight of said material.

2. A material according to claim 1, wherein said organic powder comprises any one of the following components: polyester, polymethyl acrylate, and polyimide.

3. A material according to claim 1, further comprising a ceramic powder.

4. A material according to claim 3, wherein said ceramic powder represents 5% to 20% of the total weight of said material.

5. A material according to claim 3, wherein said ceramic powder comprises any one of the following components: boron nitride, molybdenum disulfide, graphite, talc, bentonite, and mica.

6. A material according to claim 1, wherein said metal powder further comprises one or more of chromium, molybdenum, nickel, silicon, and iron.

7. A material according to claim 1, wherein the one or more additional metal elements of said metal powder represents not more than 10% of the weight of said metal powder.

8. A material according to claim 1, wherein said metal powder represents 65% to 90% of the total weight of said material.

9. A material according to claim 1, wherein said metal powder is an AlMn5 alloy.

10. A material according to claim 9, further comprising hexagonal boron nitride and polyester.

11. An abradable coating for a seal, the coating being obtained by thermal sputtering of a powder material according to claim 1.

12. A powder material for forming an abradable coating, the material comprising:

an AlMn5 alloy metal powder based for the most part on aluminium and containing manganese;

hexagonal boron nitride; and polyester, wherein said AlMn5 alloy represents 75% of the total weight of the material, said hexagonal boron nitride represents 15% of the total weight of the material, and said polyester represents 10% of the total weight of the material.

13. An abradable coating for a seal, the coating being obtained by thermal sputtering of a powder material according to claim 12.

14. A powder material for forming an abradable coating, the material comprising:

an AlMn5 alloy metal powder based for the most part on aluminium and containing manganese, the manganese of said metal powder representing 5% to 20% by weight of said metal powder, and said metal powder comprising one or more additional metal elements, individual quantities of each additional metal element being less than 5% of the weight of the metal powder;

hexagonal boron nitride; and polyester, wherein said AlMn5 alloy represents 75% of the total weight of the material, said hexagonal boron nitride represents 15% of the total weight of the material, and said polyester represents 10% of the total weight of the material.

15. A seal comprising a coating obtained by a powder material according to claim 1.

16. A seal comprising a coating obtained by a powder material according to claim 12.

17. A turbomachine compressor comprising a seal according to claim 15.

18. A turbomachine compressor comprising a seal according to claim 16.

19. A turbomachine comprising a seal according to claim 15.

20. A turbomachine comprising a seal according to claim 16.

* * * * *